US005692239A

United States Patent [19]

Lewis

[11] Patent Number: 5,692,239

[45] Date of Patent: Dec. 2, 1997

[54] SLEEVE HOLDER AND GARMENT INCLUDING SAME

[76] Inventor: Donald G. Lewis, 2250 Third Ave., San Diego, Calif. 92101

[21] Appl. No.: 771,935

[22] Filed: Dec. 23, 1996

[51] Int. Cl.[6] ..... A41B 1/08

[52] U.S. Cl. ..... 2/125; 2/269; 2/115

[58] Field of Search ..... 2/125, 269, 115, 2/108, 85, 93, 94, 69

[56] References Cited

U.S. PATENT DOCUMENTS

| | | | |
|---|---|---|---|
| D. 294,305 | 2/1988 | Meek . | |
| 3,045,246 | 7/1962 | Hoff | 2/269 |
| 4,475,252 | 10/1984 | Peyser et al. | 2/125 |
| 4,569,089 | 2/1986 | Nesse . | |
| 4,837,860 | 6/1989 | Roberts et al. . | |
| 5,299,323 | 4/1994 | Schaefer et al. . | |
| 5,315,712 | 5/1994 | McTaggart . | |

*Primary Examiner*—Gloria Hale

*Attorney, Agent, or Firm*—Brown, Martin, Haller & McClain LLP

[57] ABSTRACT

A sleeve holder for securing a drawn-up sleeve of a garment is described. Also described is the sleeved garment into which the sleeve holder is incorporated. The sleeve holder has an epaulet strap which is secured to the shirt at the shoulder and projects down the sleeve. Cooperating connectors operate such that when the wearer pulls up the sleeve the connectors engage and hold the sleeve in the drawn-up position. When the wearer wants to return the sleeve to its fully extended normal position, the connectors are disengaged and the sleeve falls to its normal length. The connectors can be cooperating button and button hold, snap elements or, preferably, hook-and-loop fabric strips, especially when oriented at right angles to each other. Use of the sleeve holder prevents a sleeve from interfering with the wearer's activities or becoming soiled or entangled during those activities.

15 Claims, 1 Drawing Sheet

SLEEVE HOLDER AND GARMENT INCLUDING SAME

BACKGROUND OF THE INVENTION

1. Field of the Invention

The invention herein relates to shirts, blouses, sweaters and other garments to be worn over the shoulders and arms. More particularly it relates to sleeved garments and devices for keeping such sleeves from interfering with activities of the wearer.

2. Description of the Prior Art

Sleeved garments such as shirts, blouses, dresses, sweaters and jackets (hereinafter sometimes referred to collectively as "shirts") are normal items of apparel. In some instances, however, sleeves of such garments can interfere with a wearer's activities. If one considers activities such as golf, tennis, gardening and the like which are conducted out of doors, sleeves can interfere with arm, wrist and hand movements of the wearer or can become soiled during the wearer's activities. For instance, sleeves can interfere with a golfer's club swing or a tennis player's racquet swing, or the sleeve cuffs can drag in the dirt as the wearer does hand work tending a garden.

Even with indoor activities, sleeves can be interfering. For instance, a sleeve can interfere with writing or cooking, such as by dragging through ink on a just-written page or getting food stains as a cook hand-mixes recipe ingredients in a mixing bowl.

Various types of "sleeve holder" devices have been used in the past to retract and hold sleeves up and out of the way of the wearer's hands, wrists and lower forearms. Garters, rubber bands and similar elastic bands have commonly been used, as have been buckled, buttoned or snapped straps, and also safety pins and various types of clips. All of these have had disadvantages, particularly in their lack of ability to be easily and quickly engaged and disengaged. In addition, most such devices when disengaged separate completely from the sleeve, thus requiring that the wearer find somewhere to place the sleeve holder after disengaging it from the sleeve. In many cases, especially out of doors, this is inconvenient and, if the wearer is moving from place to place (as on a golf course) perhaps impossible.

Various other types of sleeve adjusting means are known, but are not satisfactory for rapid and reversible sleeve adjustments. For instance, U.S. Pat. No. 4,475,252 (Peyser et al.) discloses epaulets which cooperate with loops formed on the interior of the sleeve cuff when the sleeve is rolled up adjacent to the shoulder. This system requires time-consuming and precise rolling and unrolling of the sleeve to function, a practice which is not acceptable to persons, such as golfers, who just want to have the sleeve retracted momentarily during a golf swing. In addition, the interior loops on the sleeve cuffs are themselves annoying and distracting to a wearer. U.S. Pat. No. 5,299,323 (Schaefer et al.) discloses garments including jackets which include drawstrings within the sleeves which permit the sleeves to be adjusted to different lengths for wearers of different heights, arm lengths, etc. The garments are intended primarily for the rental market, such as for rental of formal wear, where the same garment will be rented to a succession of temporary wearers of different sizes, who will adjust the garments prior to donning them. Such a system is not practical for rapid and reversible sleeve retraction. The drawstrings are inside the garment, so the sleeve length can be adjusted only when the wearer does not have the garment on. The system also causes the excess material to be drawn up inside the garment, so that it is not visible from the outside when the wearer has the garment on; bunching of sleeve material inside the sleeve can also interfere with the wearer's golf swing, tennis swing, etc.

It would therefore be advantageous to have a means of quickly and reversibly retracting a garment sleeve which would be usable without doffing the garment, would not result in bunched material inside the garment, would not require the garment to contain distracting and uncomfortable interior loops of material or other interior appurtenances, and would not have the various other disadvantages of the prior art devices and garments into which they are incorporated.

SUMMARY OF THE INVENTION

I have now developed a sleeve holder device which is readily and quickly engagable and disengagable; in which engagement and disengagement is simply accomplished, even by those with some limitations in hand function; and which can remain attached to the sleeve and garment whether engaged or disengaged. It does not include any structures on the interior of the garment, and is fully operable while the wearer wears the garment in its usual manner. It is widely adjustable to accommodate the preferences of individual wearers for the amount and positioning of sleeve retraction. My sleeve holder is such that it can be integrated in style and color with the shirt, or can appear as a stylish contrast to the shirt. It is both simple and effective for its purpose.

The first element of the invention is in the form of an "epaulet" strap which is secured to the shirt at the shoulder and projects down the sleeve. A second element is a connecting piece which is secured to the shirt sleeve at a short distance down the sleeve from the shoulder seam, usually farther down the sleeve than the epaulet strap will reach when the sleeve is at its normal extension. The epaulet contains a connecting member which cooperates with the connecting piece such that when the wearer pulls up the sleeve, creating folds of drawn up material adjacent the shoulder seam and moving the connecting piece toward the shoulder seam, the connecting member of the epaulet and the connecting piece on the sleeve can engage and hold the sleeve in the drawn-up position. When the wearer wants to return the sleeve to its normal position, the connecting member and the connecting piece are easily disengaged, and the sleeve falls to its normal length or position.

The invention contemplates using two halves of a snap or a button and button hole as the connecting member and connecting piece, but those are less preferred since they can be hard to manipulate and they require precise alignment of the two parts. Preferred in this invention is to use opposite-facing and therefore cooperating strips of hook-and-loop fastener fabric (such as that commercially available under the mark "VELCRO™." It is also preferred to orient such strips at right angles to each other such that they will engage even if the sleeve is not retracted equally each time or if the sleeve twists as it is retracted.

In a broad embodiment, this invention is a sleeve holding device comprising an epaulet member having first and second opposed ends, an upper side and a lower side, the first end securable to a sleeve containing garment; releasable first fastening means secured to the lower side over a substantial portion thereof extending from adjacent to second end; and releasable second fastening means cooperative with the first fastening means and securable to the sleeve of the garment at a position aligned with the ends of the epaulet member and spaced apart from the second end; such that when the sleeve is raised from its normal position the first and second fastening means can be engaged, thereby retaining the sleeve in raised position, and when the first and second fastening means are disengaged, the sleeve returns to its normal, unraised position.

The invention also includes the garment into which the sleeve holding device is incorporated. The garment will be any type of apparel which includes a sleeve which is sufficiently long or has a shape such that it interferes to some extent with an activity of the wearer which involves hand, arm or wrist movement. It is the potential for interference, rather than any specific sleeve length or shape, which is the controlling criterion. It will be recognized that a long sleeve, or a loose and flowing sleeve, will have a greater tendency to interfere with the user's hand, arm and wrist movements, as compared to a shorter sleeve or closely fitting sleeve which is tightly secured as with a buttoned cuff. It will also be recognized that whether or not a sleeve of a given length or shape is "inferring" will be a subjective judgment of the garment wearer. For the purposes of this invention, however, that subjective judgment is of no consequence. The sleeve holding device of this invention, and the related garment, can be used with sleeves of any significant length or shape. Apparel stores can offer sleeved garments (e.g., shirts) which are otherwise identical in size and sleeve length and shape, but with one incorporating the sleeve holding device of this invention and the other without such device, and the buyer will choose one or the other depending on his or her individual opinion as to whether the sleeve length and shape would "interfere" with any of his or her activities. Therefore, when the term "sleeve" is used herein, and unless the context suggests otherwise, it will be assumed that the sleeve in question is one which at least some potential wearers would find to be interfering with some of their activities.

The "sleeved garments" will include shirts, blouses, sweaters, or any other kind of sleeved apparel, regardless of what individual name is given to the specific piece of apparel itself. Thus, for instance, "shirts" can include golf shirts, dress shirts, sport shirts, work shirts, etc.

Therefore, in another broad embodiment, the invention is a garment which comprises a sleeve; a shoulder portion attached to the sleeve and covering the wearer's shoulder; and a sleeve holding device comprising an epaulet member having first and second opposed ends, an upper side and a lower side, the first end secured to the shoulder portion of the garment and elongated in the direction of the sleeve; releasable first fastening means secured to the lower side over a substantial portion thereof extending from adjacent to second end; and releasable second fastening means cooperative with the first fastening means and secured to the sleeve of the garment at a position aligned with the ends of the epaulet member and spaced apart from the second end; such that when the sleeve is raised from its normal position the first and second fastening means can be engaged, thereby retaining the sleeve in raised position, and when the first and second fastening means are disengaged, the sleeve returns to its normal, unraised position.

Details of the sleeve holder and garment will be set forth below.

DETAILED DESCRIPTION AND PREFERRED EMBODIMENTS

For brevity herein, the garment will be described as a shirt. As briefly mentioned above, however, it will be understood that in this invention the sleeve holder can be used in cooperation with any sleeved garment including, but not limited to, shirts, blouses, sweaters, dresses or jackets.

Figure 1:
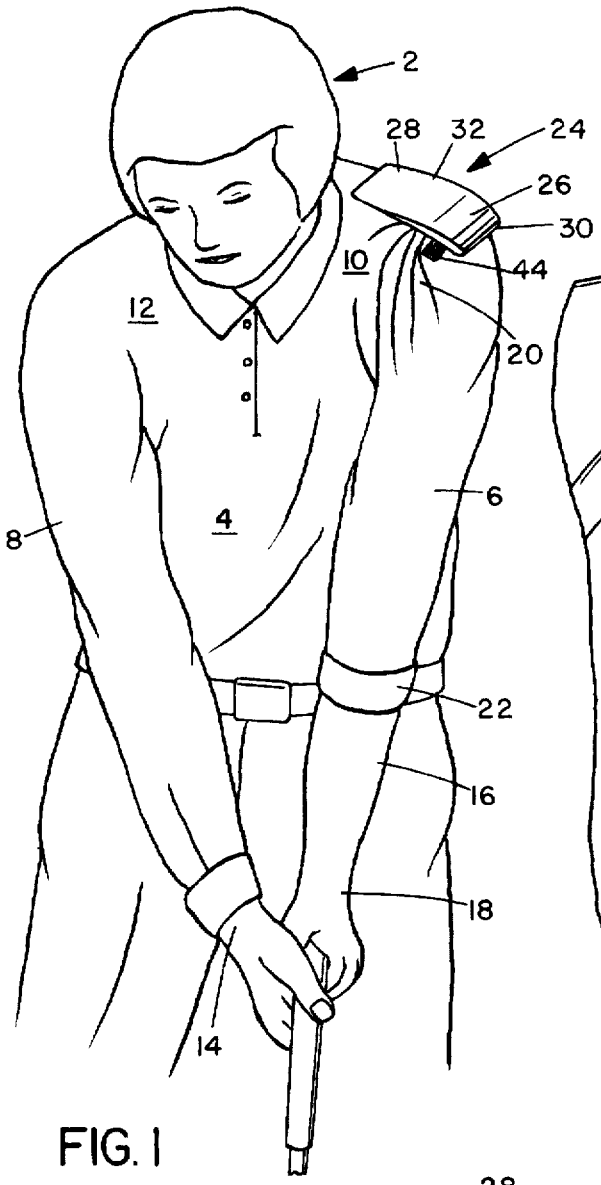
FIG. 1 is a front perspective view illustrating an embodiment of the sleeve holder device of this invention, incorporating hook-and-loop cooperative elements, in use with a garment of this invention, in this case a golfer's shirt, and engaged to lift the golfer's sleeve away from the hand.

The invention will be best understood by reference to the drawings. FIG. 1 illustrates a golfer 2 wearing a sleeved garment 4 exemplified as a typical sleeved golf shirt. The shirt has left sleeve 6 and right sleeve 8 attached respectively to shoulder portions 10 and 12 of the shirt 4. Right sleeve 8 is illustrated in its normal length, which in this example reaches approximately to right wrist 14 of the wearer 2. Left sleeve 6 is of the same normal length, but is illustrated as being pulled upward along the wearer's left arm 16 away from the left wrist 18. In the illustration shown in FIG. 1, the golfer's purpose in moving the left sleeve 6 away from the left wrist 18 is to avoid interfering with his or her golf swing. (The golfer's stance is shown for a right handed golfer. If the golfer 2 were left handed, the stance would be reversed, the right sleeve 8 would be pulled up and the left sleeve 6 would be at its normal length.)

Pulling up the sleeve 6 results in accumulation of excess material in folds 20 at the junction of the sleeve 6 and the shoulder portion 10 of the garment 4. In the illustration shown in FIG. 1, the cuff end 22 of pulled-up sleeve 6 is positioned just below the wearer's left elbow. The exact amount by which the sleeve will be pulled up and the raised position of cuff 22 will depend upon the desires of the wearer 2. As will be discussed below, the sleeve holding device 24 of the present invention will accommodate a wide range of sleeve positions.

The sleeve holding device 24 consists of an elongated strap-like epaulet 26 which can be a single strip of fabric but preferably, for strength, is formed of a double length of fabric as best illustrated in FIGS. 2–5. The epaulet 26 has ends 28 and 30 and has an upper side 32 and a lower or under side 34. The epaulet 26 may be made of any convenient fabric which can be secured to the shoulder portion 10 of the garment 4 and to which the fastening devices described below can be secured. Fabrics of cotton, wool, synthetic materials, leather or any other suitable material may be used. Preferably the epaulet 26 may be made of the same fabric as the garment 4 itself for appearance purposes. Similarly, for appearance purposes, a like epaulet (either functional or nonfunctional) may be placed on the opposite shoulder 12 to give a balanced appearance to the garment.

Secured to or incorporated in epaulet 26 is a fastening device 36. The fastening device may be a button hole 50 or the male or female half of cooperative snap elements 52. Preferably, however, the fastening device 36 will be formed of hook-and-loop fastening material secured to the underside 34 of epaulet 26. The hook-and-loop fastening device 36 may be in the form of a single strip or a plurality of strips of narrow or broad width or a plurality of spots or other forms. The area of the underside 34 covered by the fasteners 36 should be substantial and reach generally from end 30 toward, but not quite reaching, end 38. The greater the length of fastener 36, the greater the adjustability of the device will be, as will be explained below.

By not extending the fastener 36 completely to end 28, a portion or area 38 of the underside 34 is left clear to provide for securing the epaulet 26 to the garment 4 at the shoulder 10. Any convenient means of securing the epaulet to the garment may be used, including stitching 40 or an adhesive layer 42 between the underside 34 and the shoulder 10. If it is desired that the epaulet could be removable, the stitching or adhesive could be replaced by buttons, snaps, or another pair of cooperating hook and loop fasteners, one attached to the shoulder 10 and the other attached to the underside 34 of the epaulet 26. It is preferred, however, that the epaulet 26 be permanently secured and capable of being fastened down when disengaged.

Attached to the upper portion of sleeve 6 is a second fastener 44 which cooperates with fastener 36. If the fastener 36 were a button hole 50, the second fastener 44 would be a button 48. Similarly, if the fastener 36 were a male or female snap element 52, the second fastener 44 would be the corresponding female or male snap element. Each of these pairs of cooperative fasteners 36/44 is less preferred, however, since each pair requires precise alignment of the button 48 and the button hold 50 or of the two snap elements 52. While this type of alignment may certainly be obtained, it may be awkward to do so, especially if the shirt material is heavy or thick or if the wearer's arm or hand usage is impaired or limited in some way. Consequently, it is preferred that fastener 44 is a hook and loop fabric of the same type as fastener 36, and more preferred that each hook-and-loop fastener 36 or 44 be in the form of one or more elongated strips. While each fastener strip 44 may be oriented in any direction, it is preferable to have it oriented essentially at right angles to the orientation of the fastener strip(s) 36 and to have fastener strip 44 have a substantial length. It will thus be seen that with the elongated fastener strips 36 and 44 and their perpendicular orientation, they will engage satisfactorily regardless of a substantial degree of twisting which can occur when a sleeve is pulled up, and also generally regardless of the exact distance which the wearer wishes to retract the sleeve 6.

Figure 2:
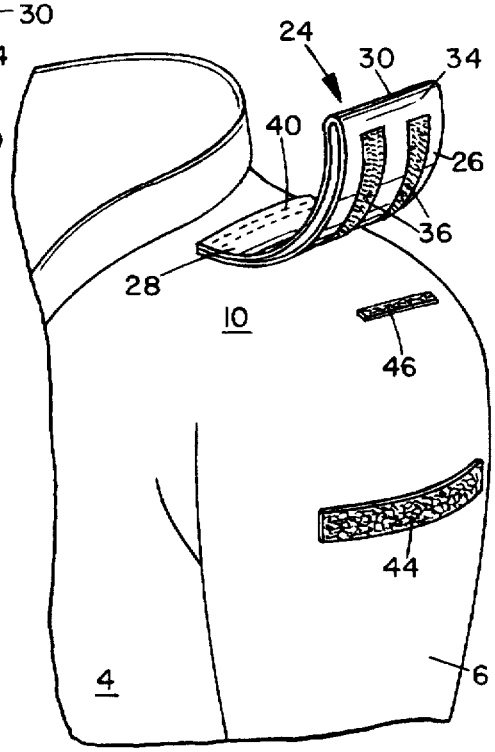
FIG. 2 is a perspective detail view of the sleeve holder of FIG. 1 in a disengaged position.
Figure 4:
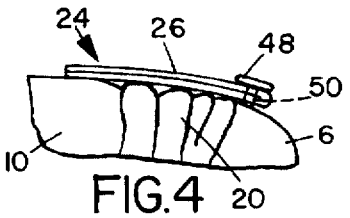
FIGS. 4 and 5 are partial side elevation views illustrating embodiments of the sleeve holder device of this invention incorporating, respectively, cooperative button and button hole and cooperative snap elements.
Figure 5:
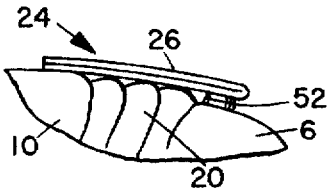
Figure 3:
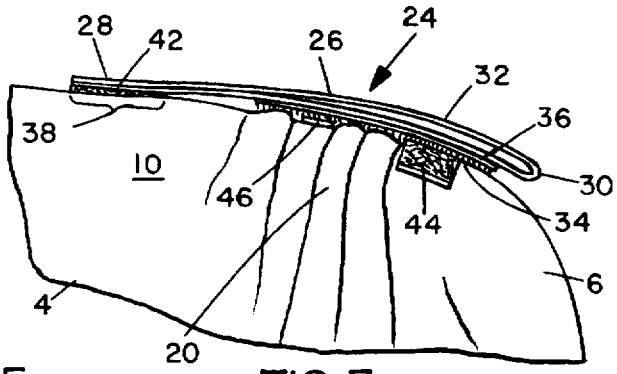
FIG. 3 is a front elevation detail view of a typical sleeve holder of this invention in an engaged position.

To use the invention, the garment wearer 2 first loosens the epaulet 26 from end 30, except where it is secured at end 28, as shown in FIG. 2. The sleeve 6 is then pulled up to the degree desired by the wearer to form the folds 20. The wearer then simply pushes the epaulet 26 down against the sleeve 6 so that the fasteners 36 and 44 engage as illustrated in FIG. 3, thus securing the sleeve 6 in the raised position as illustrated in FIG. 1. When the wearer wants the sleeve 6 to be returned to its normal length, he or she merely lifts up the epaulet 26 by raising end 30 to cause the fasteners 36 and 44 to disengage. The sleeve then falls to its normal position, eliminating the folds 20. Use of a buttoned or snapped device 24 would be conducted similarly, except of course that button 48 would be engaged in button hole 50 and the male and female snap elements 52 would be mated.

Normally, the fastener 44 will be secured to sleeve 6 at a point which, when the sleeve is at its normal length, is beyond the end 30 of the epaulet 26. This prevents the fasteners 36 and 44 from inadvertently becoming engaged and restricting the movement of the sleeve when fully extended. Such positioning also provides for raising the sleeve and cuff end 22 higher on the arm than would be possible if the fastener 44 were secured closer to the shoulder 10. In order to keep the epaulet 26 from flapping or other unwanted movement, it is preferable to include a third cooperative fastener 46 attached to the garment at or near the junction of the sleeve 6 and shoulder portion 10, and positioned underneath the lower surface 34 of the epaulet 26. When the fasteners 36 and 44 are disengaged and the sleeve is at its normal length, the epaulet 34 can be engaged with the fastener 46 and the cooperative fasteners 36 and 46 engage, holding the epaulet in position until the wearer again wishes to raise the sleeve 6 and engage the fasteners 36 and 44 to hold the sleeve in the raised position. (Where in button-and-button hole or snap embodiment is used, the third cooperative fastener 46 will be equivalent to the fastener 44 and will be positioned to engage the buttonhole or mating snap element in the epaulet 24 when the epaulet 24 is laid flat.

It will be evident that while this invention is illustrated as single epaulet on the user's left shoulder, it may also be positioned as a single epaulet on the right shoulder, or two epaulets, one on each shoulder, and in all cases with the cooperating fasteners 44 and 46 positioned on the respective sleeve or sleeves. Single epaulet sleeve holder devices would be favored by golfers, tennis players and those who engage in activities in which one arm either predominates or is most likely to be interfered with by a sleeve, while dual epaulet sleeve holding devices may be favored for garments for gardeners, wood workers, people doing carpentry, electrical, plumbing or other home repair or maintenance work, mechanics, or anyone else doing work in which both arms and hands are likely to be engaged and in which a sleeve on either arm could be interfering, could be likely to become soiled or could become entangled in machinery.

As noted above, the epaulet 26 may be of any kind of fabric and can be of the same fabric as the garment to blend into the garment color and style. Alternatively however, one may wish to have the epaulet be of a distinctive color or colors, or of a contrasting material, or be adorned with a distinctive design or logo. For instance, if several members of a college or university golf team wear a garment of this invention, they may wish to all have epaulets bearing their school's colors.

It will be evident that there are numerous embodiments of this invention which are not expressly set forth above, but which are clearly within the scope and spirit of the invention. The above description is therefore intended to be exemplary only, and the full scope of the invention is to be determined solely by the appended claims.

I claim:

1. A sleeve holding device comprising an epaulet member having first and second opposed ends, an upper side and a lower side, said first end securable to a sleeve containing garment;

releasable first fastening means secured to said lower side over a substantial portion thereof extending from adjacent to said second end; and releasable second fastening means cooperative with said first fastening means and secured to the outer side of said sleeve of said garment at a position aligned with said ends of said epaulet member and spaced apart from said second end;

such that when said sleeve is raised from its normal position in an amount equal to the distance between said first and second fastening means, said first and second fastening means can be engaged, thereby retaining said sleeve in raised position, and subsequently said first and second fastening means can be disengaged, whereby said sleeve returns to its normal, unraised position.

2. A device as in claim 1 where said first and second fastening means comprise cooperative hook-and-loop fastening fabrics, cooperative button and button hole or cooperative snap elements.

3. A device as in claim 2 where said first and second fastening means comprise cooperative hook-and-loop fastening fabrics.

4. A device as in claim 1 further comprising third fastening means cooperative with and positioned opposite said first fastening means and securable to said garment, whereby said first fastening means is engagable with said third fastening means to secure said epaulet member against undesired movement when said first and second fastening means are disengaged.

5. A device as in claim 4 wherein said third fastening means comprises a hook-and-loop fastening fabric.

6. A device as in claim 1 wherein said first end of said epaulet member comprises an area free of said first fastening means to receive means for securement to said garment.

7. A garment which comprises:

a sleeve;

a shoulder portion attached to said sleeve and covering said wearer's shoulder; and a sleeve holding device comprising an epaulet member having first and second opposed ends, an upper side and a lower side, said first end secured to said shoulder portion of said garment and elongated in the direction of said sleeve;

releasable first fastening means secured to said lower side over a substantial portion thereof extending from adjacent to said second end; and releasable second fastening means cooperative with said first fastening means and secured to the outer side of said sleeve of said garment at a position aligned with said ends of said epaulet member and spaced apart from said second end;

such that when said sleeve is raised from its normal position in an amount equal to the distance between said first and second fastening means, said first and second fastening means can be engaged, thereby retaining said sleeve in raised position, and when said first and second fastening means can be disengaged, whereby said sleeve returns to its normal, unraised position.

8. A garment as in claim 7 where said first and second fastening means comprise cooperative hook-and-loop fastening fabrics, cooperative button and button hole or cooperative snap elements.

9. A garment as in claim 8 where said first and second fastening means comprise cooperative hook-and-loop fastening fabrics.

10. A garment as in claim 7 further comprising third fastening means cooperative with and positioned opposite said first fastening means and secured to said shoulder portion of said garment, whereby said third fastening means is engagable with said third fastening means to secure said epaulet member against undesired movement when said first and second fastening means are disengaged.

11. A garment as in claim 10 wherein said third fastening means comprises a hook-and-loop fastening fabric.

12. A garment as in claim 7 wherein said first end of said epaulet member comprises an area free of said first fastening means and said first end of said epaulet member is secured to said shoulder portion of said garment at said area.

13. A garment as claim 12 wherein said epaulet member is secured to said shoulder portion of said garment by stitching through said area and said shoulder portion adjacent said area.

14. A garment as claim 12 wherein said epaulet member is secured to said shoulder portion of said garment by an adhesive layer between said lower side at said area and said shoulder portion adjacent said area.

15. A garment as in claim 7 which comprises a shirt, blouse, sweater, jacket or dress.

* * * * *